United States Patent [19]

Justman

[11] 4,037,673

[45] July 26, 1977

[54] ROLLER CUTTER DRILL BIT

[75] Inventor: Daniel B. Justman, Houston, Tex.

[73] Assignee: Reed Tool Company, Houston, Tex.

[21] Appl. No.: 684,125

[22] Filed: May 7, 1976

[51] Int. Cl.[2] ..... E21B 9/10

[52] U.S. Cl. ..... 175/371

[58] Field of Search ..... 175/227-229, 175/371-372; 308/8.2

[56] References Cited

U.S. PATENT DOCUMENTS

| | | | |
|---|---|---|---|
| 2,174,102 | 9/1939 | Catland | 175/229 |
| 2,906,504 | 9/1959 | Parks | 175/228 |
| 3,251,634 | 5/1966 | Dareing | 175/228 |
| 3,365,247 | 1/1968 | Ferrand | 175/227 |
| 3,761,145 | 9/1973 | Schumacher, Jr. | 175/371 |
| 3,765,495 | 10/1973 | Murdoch et al. | 175/371 |
| 3,923,348 | 12/1975 | Peck | 175/372 |

*Primary Examiner*—James A. Leppink

*Attorney, Agent, or Firm*—Neal J. Mosely

[57] ABSTRACT

An earth boring drill employing roller cutters is provided with a seal in a peripheral groove to inhibit ingress of detritus into the cutter bearing area and egress of lubricant therefrom. The shape of the seal is such that its cross section is not overly compressed or displaced when in operating position, thus preventing undue compression set, wear and heating of the seal. A preferred seal has a greater radial dimension than axial dimension by a ratio of at least one-and-one-half to one to conserve bearing space and to provide the necessary flexibility to accommodate the various movements of the cutter relative to the shaft upon which it is rotatably mounted. The roller cutter has a counterbore fitting over a short cylindrical boss from which the shaft extends on which the cutter is mounted. This provides a tortuous passage restricting ingress of detritus and substantially improved life of the drill bit.

3 Claims, 1 Drawing Figure

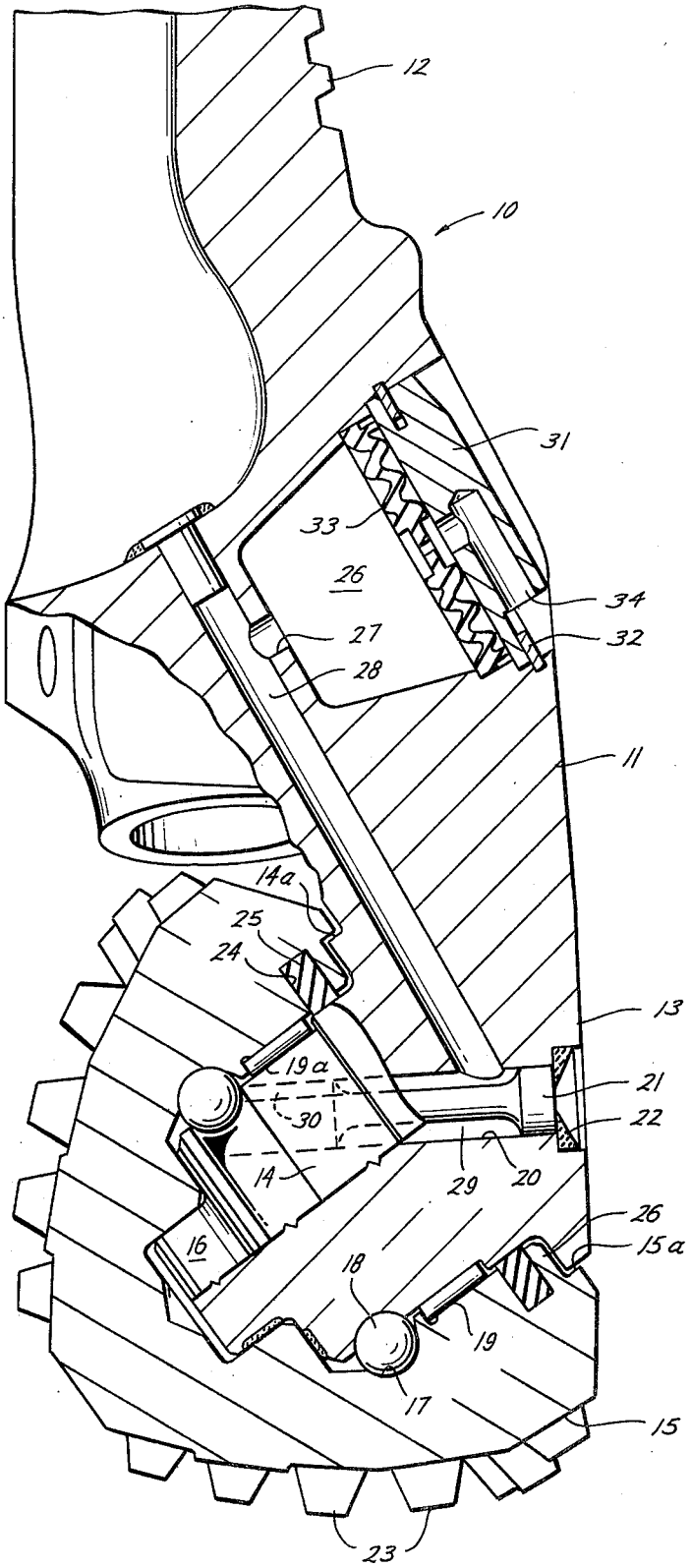
12
10
31
33
26
34
27
32
28
11
14a
25
24
13
19a
21
30
22
14
29
20
26
16
15a
18
19
17
15
23

ROLLER CUTTER DRILL BIT

BACKGROUND OF THE INVENTION

1. Field of the Invention

This invention relates to earth boring drill bits of the roller cutter type and more particularly to improvements in seal means and in bearing construction therefor to confine a lubricant in the bearing area interiorly of the cutter and to keep formation cuttings and other detritus out of such bearing area.

2. Description of the Prior Art

During drilling operation, the seal of a roller cutter earth boring bit encounters fluctuations in position and fluid pressure since the drill bit operates at various depths in a well in which drilling fluid is employed, and the cutter movement is complex relative to its bearing shaft in that it includes rapid axial and radial as well as wobbling motions, the magnitudes of which change as the parts are worn. Thus, a drill bit seal should operate under various conditions of operation and wear if it is to be effective to protect the bearings and enhance the useful drilling life of the bit. Also, it is desired that the seal take up as little axial space as practical so that adequate bearing capacity remains.

The prior art teaches primarily the use of rubber or other elastomeric seals in the form of an "0" ring, or the seal might be approximately square in cross-section. Packing type seals usually are solid in cross-section and are single piece seals of a single material, unlike lip seals or seals made of more then one material.

Seal manufactures have recommended that for rotary applications, an "0" ring seal, for example, should be compressed in cross-section less than 10% to prevent undue compression set, fatigue, wear and heating of the seal. For rock bit applications, the clearances and the movements between the parts may be quite large so that the seal in order to be effective must be compressed sufficiently to be able to bridge such clearances between the cutter and its shaft as may occur. This may indicate that the seal should be compressed in cross-section more than 10% because for an "0" ring having a cross-sectional diameter of 0.139 inches, a 10% squeeze would be only about 0.014 inches whereas the cutter movement toward and away from its shaft may be substantially more than 0.014 inches. However, simply to compress the seal more than 10%, which would solve the problem of greater amounts of movement of the parts, may result in compression set and other seal problems as previously stated.

It would seem that a solution to the problem would be to use an "0" ring having a substantially larger cross-sectional diameter such that the percent compression would be small while the total compression of the ring would be sufficient to take care of the expected cutter movements. However, in rock bits the space available is very limited and the use of large "0" rings would result in less room for the bearings, so this would not be a practical solution. Murdoch, et al U.S. Pat. No. 3,765,495 discloses the use of a radially elongated seal in hoop compression which gives the improved sealing capacity needed in a limited space.

SUMMARY OF THE INVENTION

It is an object of this invention to provide a roller cutter having a seal in a peripheral groove fitting around the supporting shaft in which the total radial compression or displacement of the seal cross section can be sufficient to provide for the clearances and movements of the cutter with respect to its shaft taking into account additional clearances resulting from bearing wear, and a counterbore on the roller cutter fitting over a supporting boss providing a tortuous passage restricting ingress of detritus.

In the practice of this invention there is provided a seal, in a peripheral groove, between a drill cutter and its bearing shaft, the parts being arranged and sized so that the seal under operating conditions is generally compressed relative to the shaft. The supporting shaft extends from a cylindrical boss. The roller cutter is mounted on the shaft and has a counterbore fitting over the boss providing a tortuous passage limiting ingress of detritus to the vicinity of the seal.

BRIEF DESCRIPTION OF THE DRAWING

The FIGURE shown is a longitudinal sectional view through a drill bit roller cutter together with its associated bearing shaft and support, boss and couterbore, illustrating this invention.

DESCRIPTION OF THE PREFERRED EMBODIMENT

Referring to the drawing, there is shown at 10 a cone cutter type of earth drill of generally conventional construction which represents one-third of a three cutter roller bit. The drill bit comprises a bit head 11 and a threaded shank 12 for connection to a drill stem (not shown). A cutter support 13 extends downwardly from the bit head and a bearing shaft 14 extends downwardly and inwardly from the support 13. The bearing shaft 14 extends from a cylindrical boss **14*a* on the support 13** which will be described more fully hereinafter.

A roller cutter 15 of generally conical shape is mounted on bearing shaft 14 and has a counter bore **15*a* at its open end fitting over the cylindrical boss 14*a* on the support 13. The roller cutter cone 15 is supported on friction bearing 16 on the shaft 14 and has a peripheral groove or bearing race 17 in which there are provided ball bearings 18. The cutter 15 has an inner bore 19 providing a bearing surface which rides on a bushing 19*a* of the floating type. Bushing 19*a* floats between the bore or bearing surface 19 or roller cone cutter 15 and the outer surface of bearing shaft 14. Bushing 19*a*** may be of any suitable material of construction such as borided steel or hardened beryllium-copper alloy or the like. The bushing should be of sufficient strength and toughness to stand the wear of the roller cutter and should be of sufficient hardness and surface lubricity to resist extrusion or galling.

In assembling the cutter 15 on shaft 14 the ball bearings 18 are inserted through passage 20 and held in place by a retaining pin 21. Retaining pin 21 is welded in place as indicated at 22. Retaining pin 21 serves to hold the ball bearings in place and has a curvature at its end portion matching the curvature of the ball bearing race 17. The cutter 15, shaft 14, support 13 and associated parts may be made of alloy steel and the cutter 15 preferably has inserts 23 therein of tungsten carbide or other suitable cutting elements.

The cutter 15 has a groove 24 extending radially outward from the bearing shaft 14 adjacent to the open end of the cutter 15. A sealing ring 25, which may be made of a suitable elastomeric material, such as Buna-N or the like is positioned in groove 24. The seal ring 25 may be an "0" ring but preferably is of generally rectangular cross section or oval or other elongated cross section in a radial dimension. The radial dimension of the ring is preferably at least one-and-one-half times the axial dimension. The sealing ring 25 may be an "0" ring but in such case the dimensions of groove 24 would be adjusted to accommodate it. The sealing ring 25 is preferably maintained in hoop compression and is compressed radially by an amount less than 10% of its radial dimension.

A flange portion 26 lies between groove 24 and counterbore 15a and helps to confine and protect the outboard side of seal ring 24 from being damaged by detritus or formation cuttings. The flange 26 and counterbore 15a define, together with the short cylindrical boss 14*a*, a tortuous passage which prevents ingress of detritus or formation cuttings. The groove 24 confines seal 25 so that its does not tip or tilt axially to any substantial extent. The groove finish may be relatively rough since it is preferred that the seal ring 25 rotate with cutter 15 and slide on bearing shaft 14.

A grease reservoir 26 in bit head 11 serves to provide lubricant to the cutter bearing through aperture 27 and passageway 28 in the bit head 11 and support 13 and channels 29 and 30 in the retaining pin 21. The reservoir 26 has a closure 31 secured in place with a snap ring 32. The closure 31 also serves to keep in place a flexible diaphragm 33 which seals the reservoir 26 from contaminants outside the drill bit. The closure 31 has a passageway 34 in communication with the outside of the diaphragm 33 and the exterior of the drill bit so that the pressure on the lubricant system is generally in balance.

When a radially elongated seal is used, the inside diameter of the seal 25 in its relaxed condition before being installed into cutter groove 24 is larger than the outside diameter of that portion of the shaft 14 which is operatively associated therewith. Also, the outside diameter of the seal 25 in its relaxed condition before being installed is larger than the maximum diameter of the cutter groove 24. Further, the inside diameter of the seal 25 after it has been installed into cutter groove 24 is smaller than that portion of the shaft 14 which is operatively associated therewith.

For example, the maximum diameter of groove 24 may be 2.805 inches. The outside diameter of the seal 25 may be 2.906 inches and the inside diameter of the seal may be 2.109 inches so that the uncompressed radial dimension of the seal 25 is 0.398 inches. The diameter of shaft 14 operating with the seal may be 2.065 inches. This provides a diametrical clearance between the seal and the shaft which is at least one percent of the inside diameter of the seal 25.

Thus, seal 25 when installed in operating position is in radial and circumferential or hoop compression. The inside diameter portion of the seal 25 is also in hoop compression even though it must be pressed on the shaft 14.

The difference between the shaft diameter 2.065 inches and the groove diameter 2.805 inches is 0.740 inches or 0.370 inches from the top of the shaft 14 to the bottom of the groove 24. The seal 25 has a radial extent of 0.398 inches. Thus, the cross section of the seal when installed is compressed radially 0.028 inches or approximately seven percent.

Since the seal 25 slides on shaft 14 when the cutter 15 is rotated, it is desirable that the seal portion in contact with the shaft have its fibers in compression. If this portion of an elastomeric seal is in tension, the seal tends to fail in fatigue forming cracks normal to the direction of seal sliding with resultant leaks and reduced drill bit life. It is believed that such failure occurs because an elastomer in tension contracts when heated and the friction of the rotating seal on the shaft causes heat. Also, if the seal is in tension where it contacts the shaft, it is believed that the seal tends to stick and slip on the shaft as it rotates thereon and such alternate static and sliding condition could subject the seal to alternate tensile and compressive stresses which may lead to fatigue failure of the seal.

As previously stated, the seal 25 is in hoop or circumferential compression in operation and such seals have been successfully tested in the field and used commercially. While the seals tested and used have been made of Buna-N of approximately 70 durometer, it is obvious that other elastomeric materials may be used. Also, while the seal 25 has been shown as having a generally rectangular cross section with rounded edges at the end portions, any suitable elongated shape may be used. The seal arrangement provides a drill bit seal which occupies little axial space so that more bearing capacity may be provided in the limited space available, and an improved seal which provides excellent fatigue characteristics.

The construction described above with the exception of the cylindrical boss 14*a* and counterbore 15*a* is disclosed essentially in U.S. Pat. No. 3,765,495. The essential novel feature of this invention is the counterbore 15*a* and cylindrical boss 14*a* which provide a tortuous passage preventing the ingress of detritus and other debris to the area of the seal 25. The alteration of the structure of a drill bit having a peripheral sealing ring in a groove by addition of the cylindrical boss 14*a* and counterbore 15*a* has resulted in an unexpected and very substantial increase in the life of the drill bit.

Ten bits were tested in the Abilene, Texas area and gave an average life of 177.75 hours and depth at failure of about 3500 feet. Average performance for standard bits of the type shown in U.S. Pat. No. 3,765,495 in the same area is 102 hours. Four bits were tested in the Great Bend, Kansas area for an average depth of 2200 feet in 108 hours. Average life for standard bits of the type shown in U.S. Pat. No. 3,765,495 in this area was 87 hours. The performance of the bits made in accordance with this invention was not only superior to the bits made in accordance with U.S. Pat. No. 3,765,495 but was also superior to competitive bits run in the same areas as measured by the life of the bits and depth of the well at the time the bit was worn out.

I claim:

1. A drill bit comprising:

at least one head, a cylindrical boss on said head having a flat end surface, a bearing shaft arranged on said head and extending from the flat end surface of said boss, a cutter rotatably mounted on said bearing shaft and having a counterbore fitting over said flat end surface and guided for rotary motion on said cylindrical boss, said cutter having a smaller bore opening from said counterbore and fitting on said bearing shaft, said cutter having a circumferential groove in said smaller bore and spaced from said flat end surface, an elastomeric seal ring in said groove in sealing engagement with said shaft, and said boss, said flat end surface and counterbore defining a tortuous passage preventing ingress of detritus to the area of the seal ring in said smaller bore.

2. A drill bit according to claim 1 in which said counterbore and cylindrical boss fit in a rotary bearing relation.

3. A drill bit according to claim 1 in which said seal ring, said groove, and said bearing shaft area confronting said groove are sized so that upon assembly of said cutter on said shaft, said seal ring is compressed less than 10% of its relaxed condition radial thickness, and said seal ring having a radial cross section dimension at least one-and-one half times its axial dimension.

* * * * *